US005082430A

United States Patent [19]

Güttinger

[11] Patent Number: 5,082,430

[45] Date of Patent: Jan. 21, 1992

[54] ROTATING SPIRAL COMPRESSOR WITH REINFORCED SPIRAL RIBS

[75] Inventor: Heinrich Güttinger, Wettingen, Switzerland

[73] Assignee: Aginfor AG fur Industrielle Forschung, Wettingen, Switzerland

[21] Appl. No.: 506,186

[22] Filed: Apr. 9, 1990

[30] Foreign Application Priority Data

Apr. 8, 1989 [CH] Switzerland ..... 01294/89

[51] Int. Cl.[5] ..... F04C 18/04

[52] U.S. Cl. ..... 418/55.2; 418/188

[58] Field of Search ..... 418/55.2, 178, 188

[56] References Cited

U.S. PATENT DOCUMENTS

| | | | |
|---|---|---|---|
| 2,324,168 | 7/1943 | Montelius | 418/55.2 |
| 3,600,114 | 8/1971 | Dvorak et al. | 418/55.3 |
| 3,924,977 | 12/1975 | McCullough | 418/55.2 |
| 4,472,120 | 9/1984 | McCullough | 418/55.2 |

FOREIGN PATENT DOCUMENTS

| | | | |
|---|---|---|---|
| 0275415 | 7/1988 | European Pat. Off. | 418/55.2 |
| 48616 | 1/1938 | France | 418/55.2 |
| 55-109792 | 8/1980 | Japan | 418/55.2 |
| 57-99202 | 6/1982 | Japan | 418/178 |
| 2200169 | 7/1988 | United Kingdom | 418/55.2 |

*Primary Examiner*—John J. Vrablik

*Attorney, Agent, or Firm*—Burns, Doane, Swecker & Mathis

[57] ABSTRACT

A rotating sprial charger for compressible media is disclosed having a housing in which two symmetrically constructed displacer disks are located and rotated by drive elements. The two displacer disks are provided on one side with helical ribs. To form a conveying space, the ribs engage each other and seal with their free frontal sides against the opposing displacer disk. To increase the strength of the ribs, a reinforcement is provided on the outer periphery of the ribs. The reinforcement is located on the outer wall of the rib and extends over the entire axial length of the ribs. The reinforcement also extends in the peripheral direction from the end of each rib on the inlet side to the end on the inlet side of the rib following in the peripheral direction.

11 Claims, 3 Drawing Sheets

ROTATING SPIRAL COMPRESSOR WITH REINFORCED SPIRAL RIBS

FIELD OF THE INVENTION

The invention concerns a rotating spiral charger for compressible media having a housing in which two symmetrically constructed displacer disks are located for rotation by means of drive elements. The displacer disks may be provided on one side with helical ribs which engage each other to form a conveyor space and which seal with their free frontal sides against the opposing displacer disk.

Spiral chargers of this type are capable of conveying gaseous working media consisting, for example, of air or an air-fuel mixture, almost without pulsation and, therefore, may be used advantageously for supercharging purposes in internal combustion engines. In the course of operation, a plurality of approximately sickle shaped work spaces are formed between the helical ribs. These spaces move from an inlet continuously to an outlet, while their volume is continuously declining and the pressure of the working medium is continuously increasing.

BACKGROUND AND SUMMARY OF THE INVENTION

A spiral machine of the above-mentioned type is known from Dvorak et al. U.S. Pat. No. 3,600,114 wherein the embodiment shown in FIGS. 8 and 9 shows a two-speed, single-stage engine, in which the two mobile displacer disks are mounted loosely on stationary eccentric axles. One of the axles is hollow to conduct the working medium to be transported out of the engine. On their circumference, the displacer disks are equipped with gear rims which are engaged by a common gear wheel mounted on a drive shaft. These multi-speed engines have the advantage that, on the one hand, each of the displacer disks is completely balanced in itself, and on the other, that a more uniform conveyance almost without pulsation is possible. In addition, the radial displacement of the two disks and, thus, the eccentricity between the two rotating axles is smaller than with single speed engines which leads to lower sliding velocities between the helical ribs. In principle, therefore, operation with higher revolutions per minute are allowed with this type of supercharger. However, at these higher rpm's the strength of the ribs presents a problem.

In the aforecited known engine, the strength of the ribs has been taken into account in that the ribs extend in the shape of a trapezoid from top to bottom. However, this solution is advantageous only in the case of spiral chargers transporting low volumes, that is, in the case in which the axial length of the ribs is small.

In addition to utilizing the aforementioned trapezoidal configuration of the ribs, it is known from U.S. Pat. No. 2,324,168 in spiral machines of the aforementioned type to also configure the cross-section of the ribs to be variable in order to supplement strength. It is proposed, for example, to shape the inner wall to both of the cooperating spirals in a purely archimedean manner while the outer walls exhibit a non-constant, increasing rise with growing angles of contact. This leads to spirals with wall thicknesses increasing from the inside out. The measure is intended primarily to obtain an improved sealing effect at the points of contact of the two spirals travelling along the helix. As a result of such configuration, the spirals on the outer periphery, i.e., in the area in which the outer wall of the spiral is no longer needed to form a conveying space and thus does not have to perform a sealing function, are too "thick", and, hence, it is recommended to configure the wall on the outer spiral part to be thinner relative to the spiral parts located further inward. Spirals with variable wall thicknesses therefore have conveying chambers wherein the walls are not parallel. Consequently, the chambers cannot be made by turning.

In the case of spiral chargers for supercharging, the large volume of media to be conveyed requires wide conveying chambers. The ribs are therefore usually formed by helical ridges that are essentially vertical and that have a larger axial length relative to their thickness. The vertical terminal edges of the ridges are thus relatively unstable at least in the area of the fiber farthest from the displacer disk, i.e. in the head region. Consequently, in operation, the terminal edges could strongly impact the foot parts of the cooperating ridges. In addition, there is significant stressing in the foot area of these terminal edges, which may even lead to fracture.

It is therefore the object of the invention to create a spiral charger of the aforementioned type in which the deformation by centrifugal forces of the ribs is largely prevented.

This object is attained utilizing ribs that ar provided on their outer periphery with reinforcements which are located on the outer wall of the ribs, which extend at least approximately over the entire axial length of the ribs, and which extend in the circumferential direction at most from the end of each rib at the inlet side to the end on the inlet side of the rib following it in the circumferential direction without affecting the inlet cross-section of the conveying space formed by the two ribs.

The advantage of the invention is to be found particularly in that the spiral parts through which the working medium is flowing can be made with the lowest possible wall thickness. With constant eccentricity, this signifies a gain in space that increases with the magnitude of the contact angle of the spirals.

It is known from EP-A-275415 to reinforce the ribs at the rib end on the inlet side within an angular range of 0° to 120° in order to protect the inlet edge of the ribs in the area of the transition to the displaced disk. Preferably, the wall thickness is to increase gradually to a maximum size at the inlet edge itself. This continuous increase is advantageously effected by a helical expansion of the outer contour relative to the inner contour or conversely by the helical decrease of the inner contour relative to the outer contour. However, this known machine is of a type in which the displacer disk is orbiting in a stationary spiral housing, which is in contrast to the present machine in which two displacer disks are rotating together. Aside from the varying manufacturing problems involved, this known measure obviously requires that the contours of the stationary spiral housing cooperating with the displacer disk also be adapted to the variable helical shape of the displacer ribs.

BRIEF DESCRIPTION OF THE DRAWING

The present invention will now be described with reference to the attached drawings which illustrate a spiral charger in accordance with the present invention and wherein.

DETAILED DESCRIPTION

Figure 1:
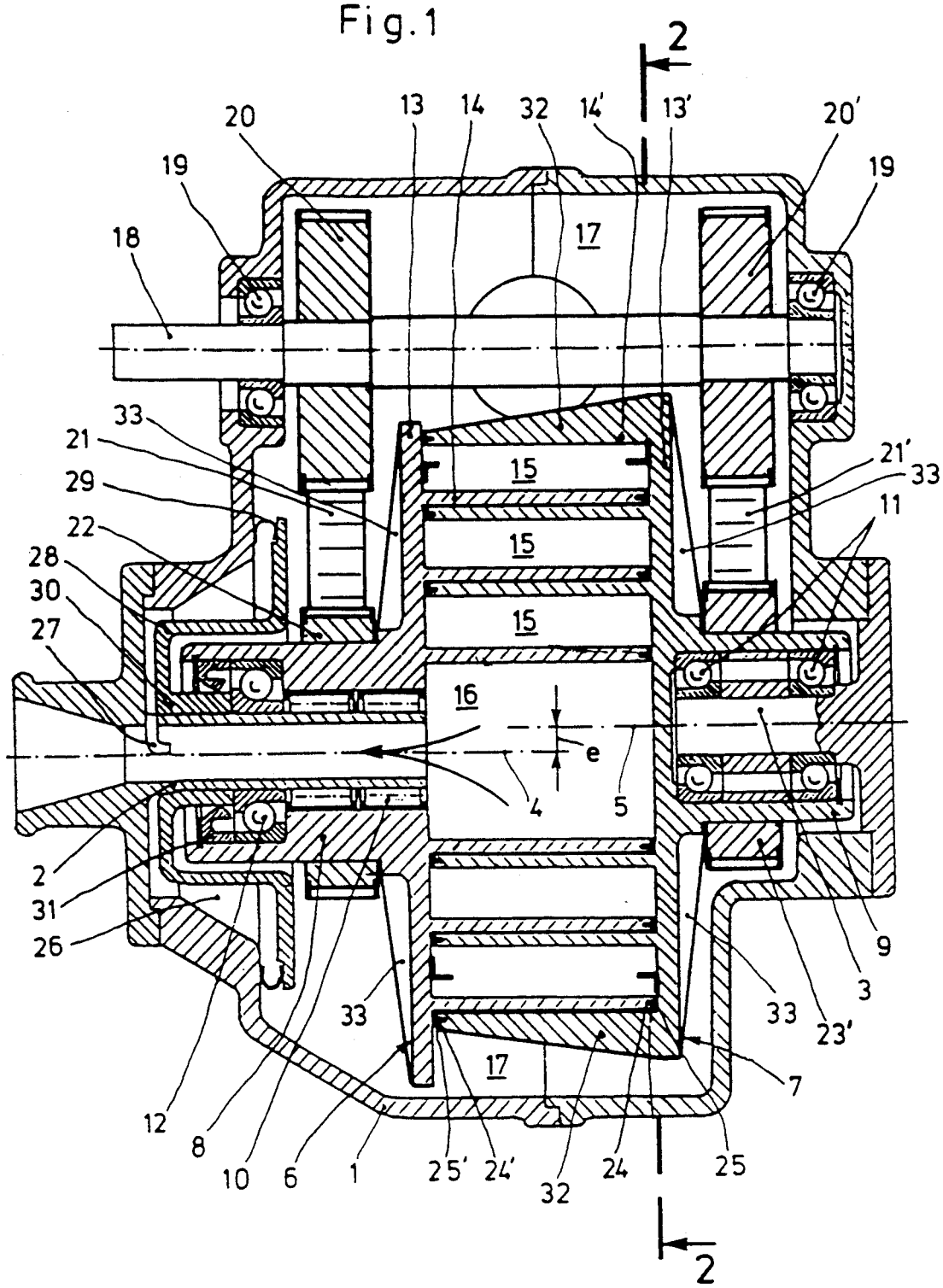
FIG. 1 is a longitudinal cross-sectional view of one embodiment of a spiral charger in accordance with the present invention.

For an explanation of the mode of operation of the compressor, reference is made to the aforecited U.S. Pat. No. 3,600,114.

In the figures, a housing composed of two halves is shown. The two halves are joined together by means of fastening lugs (not shown) which hold screw connections. On either side of the housing, axle stubs 2 and 3 are located to protrude into the housing. The longitudinal axes 4 and 5 of the axle stubs 2 and 3, respectively, are offset relative to each other by the eccentricity e. Rotating displacer disks 6 and 7 are loosely mounted on the axle stubs 2 and 3, respectively. The hub 9 of the right hand displacer disk 7 is supported by means of two ball bearings 11 on the axle stub 3 and is thus axially secured. The left hand displacer disk 6 is axially displaceable in that its hub 8 is loosely mounted on the axle stub 2 by means of two needle bearings 10 acting as journal bearings. The axle stub 2 is ground in the area of the needle bearings as it forms the running surface of the needles. This configuration requires an additional axial bearing 12, whereby forces may be transmitted to the hub 8.

The displacer disks 6 and 7 are substantially symmetrical in their layout. They comprise a flat plate, 13' which, when installed, are parallel to each other, and of ribs 14,14' set substantially perpendicular to the plates 13. These ribs 14' are helical in shape (See FIG. 2), i.e. they may either consist of conventional spirals, or they may be composed of a plurality of connecting circular arcs.

In the embodiment illustrated, each of the ribs 14,14' has an arc length of one-and-a-half windings thus giving the machine a "single stage" designation. Each plate 13,13' is provided with two such ribs 14,14' with the ribs offset by 180° relative to each other. This leads to the designation of "two-speed". In such two-speed machines, four parallel working spaces 15 are formed which represent the conveying space proper. During operation, these working spaces 15 open to the outlet 16 at intervals of ¼ revolution. On the outer diameter, the spirals open against the inlet 17, from where fresh air is sucked into the spiral.

During a proper regular, mode of operation, the radial sealing between the ribs 14,14' i.e., the closing off of the working spaces 15 in the circumferential direction, is not the only important concern. The axial sealing of the conveying spaces 15 is also essential. For axial sealing, the frontal surfaces 24 of each of the ribs 14,14') must abut against the plate 13,13' of the opposing displacer disk. This is effected usually by means of sealing strips 25,25' set into corresponding grooves in the frontal sides 24,24' of the ribs. However, as the pressure, which increases toward the inside of the spiral, tends to urge the two displacer disks apart, countermeasures must be taken.

Between the axially displaceable displacer disk 6 and the housing wall, a pressure chamber 26 is therefore formed which is exposed to the pressure of the working medium in the outlet 16 by means of a bleed pipe 27 between the pressure chamber 26 and the axle stub 2. The pressure in the chamber acts on an annular disk 28, which is fastened by means of a bellows 29 to the housing 1 in an airtight manner.

During an axial displacement due to pressure, the hub 30 of the annular disk 28 slides on the axle stub 2 and thus displaces the abutting inner cage of the axial bearing 12. Consequently, via the balls of the bearing 12, the displaceable hub 8 of the displacer disk 6 is displaced until the ribs 14,14' abut against the opposing plates.

The rear side of the annular disk 28 that is facing the displacer disks is exposed to the pressure prevailing in the inlet 17, i.e. the atmospheric pressure. It is seen that by dimensioning the active annular disk surface, a simple means is available to determine the contact pressure of the ribs against the plates. In order for a proper determination, however, the inlet pressure must be sealed from the outlet pressure through the bearings 10 and 12. This is achieved with a lip seal 31 acting between the stationary hub 30 of the annular disk 28 and the rotating hub 6 of the displacer disk 6.

Figure 2:
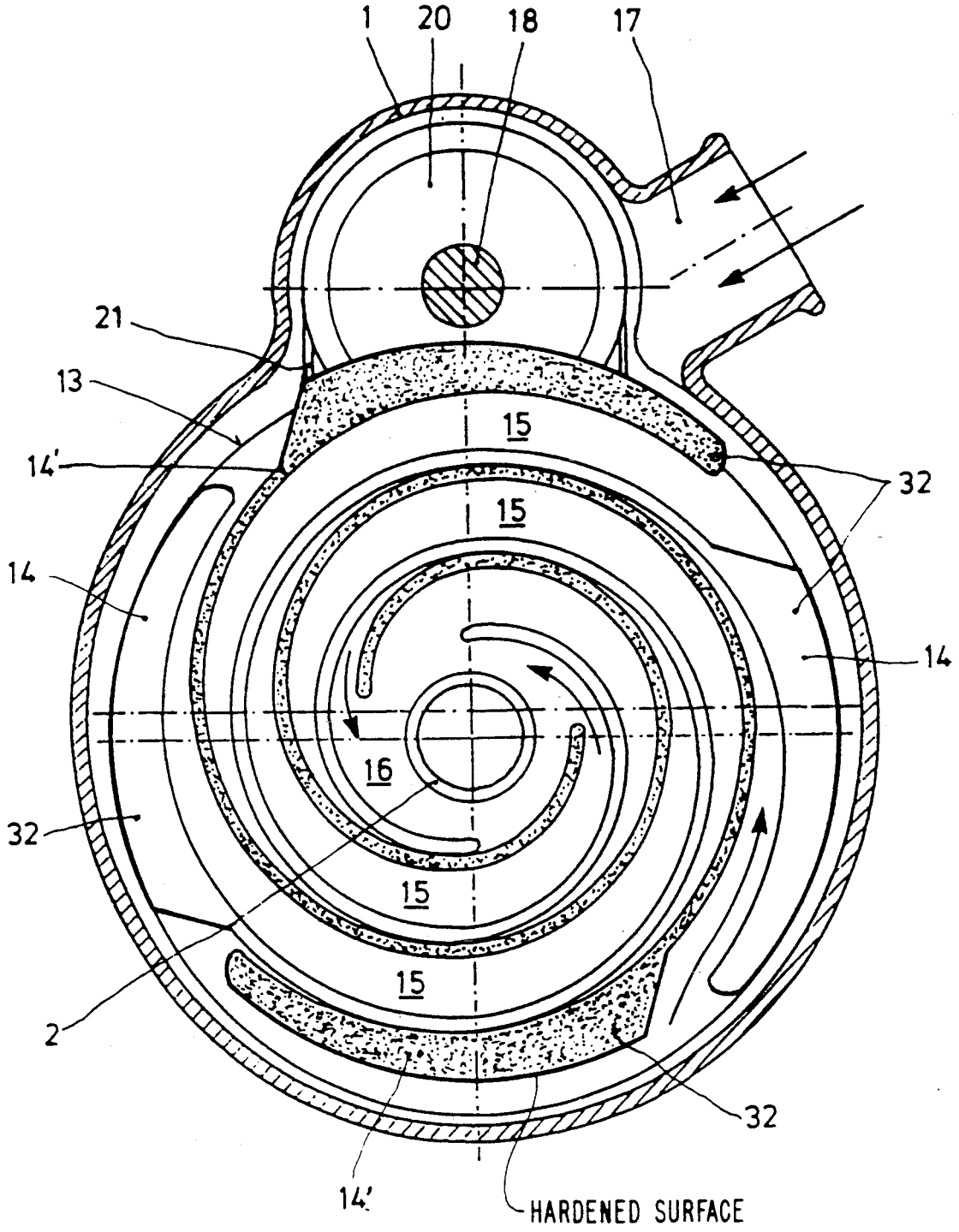
FIG. 2 is a cross-sectional view along the line 2—2 of FIG. 1.

To increase the strength of the ribs 14,14' according to the present invention, the parts of the ribs most highly stressed by the centrifugal force but not taking part in the formation of conveying spaces are provided with a reinforcement 32. As shown in FIGS. 1 and 2, these reinforcements 32 consist of thickened portions of the inlet areas, i.e., in the section of the rib located between its own radially outer end and the radially outer end of the next adjacent rib. They may be produced in a simple manner if the displacer disks are cast or sintered together with the ribs. Even if the conveyor spaces 15 are milled, the reinforcements require no further processing as they are located outside the flow channels on the outside of the rib ends. The reinforcements extend over the entire axial length of the ribs in a conical manner with an increasing cross-section from the top end to the bottom (see FIG. 1). In the circumferential direction (see FIG. 2), the reinforcement 32 begins on the outermost periphery of the rib, i.e. at its inlet edge. The reinforcement then extends into the area of the inlet edge of the adjacent rib. At the bottom part, i.e., in the location in which the rib is connected with the displacer disk, the reinforcement is flush with the outer edge of the displacer disk. Consequently, since the displacer disks are circular while the radius of the ribs is decreasing, the reinforcement becomes increasingly thicker from the end of the rib in the circumferential direction.

This last measure is not compulsory. For example, if a manufacturing advantage could be obtained, the thickening at the initial portion of the reinforcement 32 on the bottom part could follow the outline of the rib and thereby assume a constant cross-section in that location.

In the area of the adjacent rib, the reinforcement 32 extends obliquely from the outer edge of the displacer disk to the outer wall of the rib. This bevelling is chosen according to optimal technical flow criteria while preventing interference with the free and unimpeded suction of the working medium into the conveying space formed by the two ribs.

If the complete displacer unit 6, 7 is fabricated, for example, of an aluminum alloy or magnesium, the free surface of the reinforcement 32 facing the inside of the housing may be subjected to a hardening treatment in order to further improve the stability of the configuration. For example, anodizing, eloxation or the application of a layer of enamel may be utilized.

The reinforcement may also be configured to terminate radially if it does not extend into the area of the next rib. Such a configuration may be desirable, for example, with single spirals, the inlets of which are offset by 180°. The reinforcement of such a wide angular range is not necessary, since, in such a spiral, the rib parts involved are located far enough inward due to the curvature that centrifugal forces are less effective.

Figure 4:
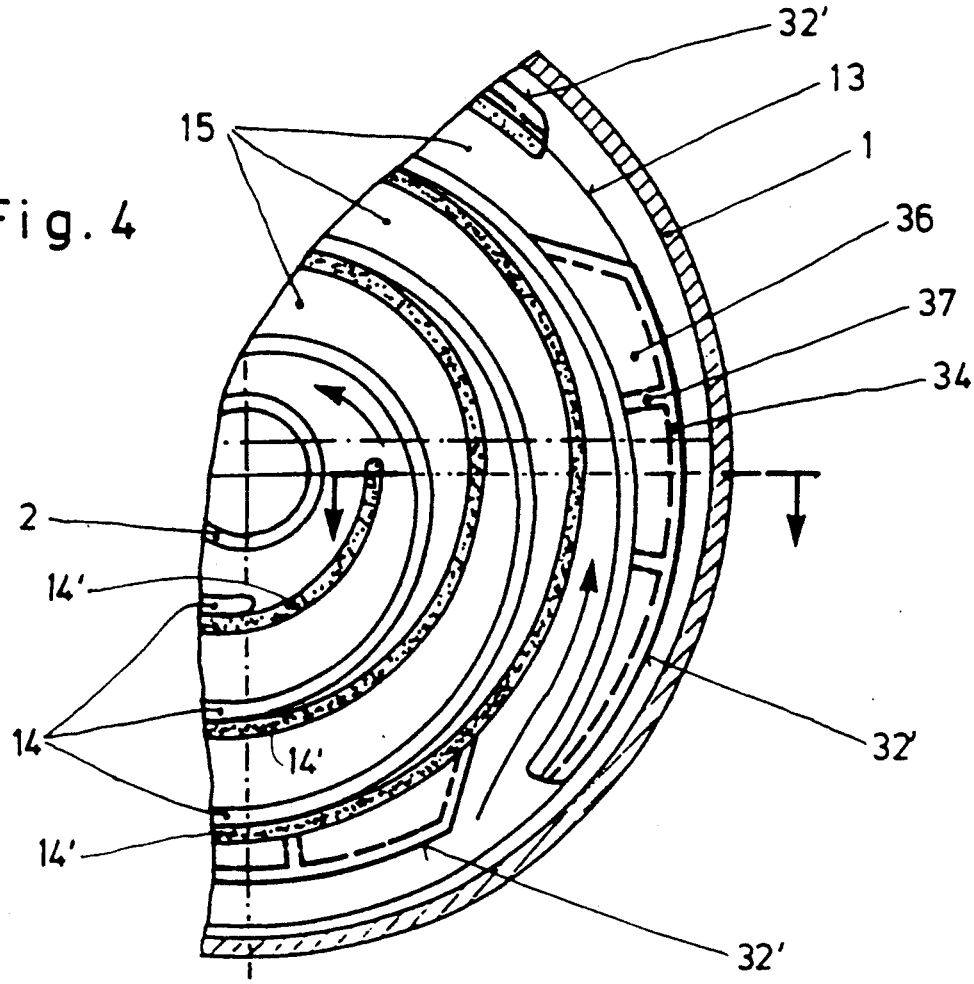
FIG. 4 is a partial cross sectional view of the second embodiment of the present invention of FIG. 3.
Figure 3:
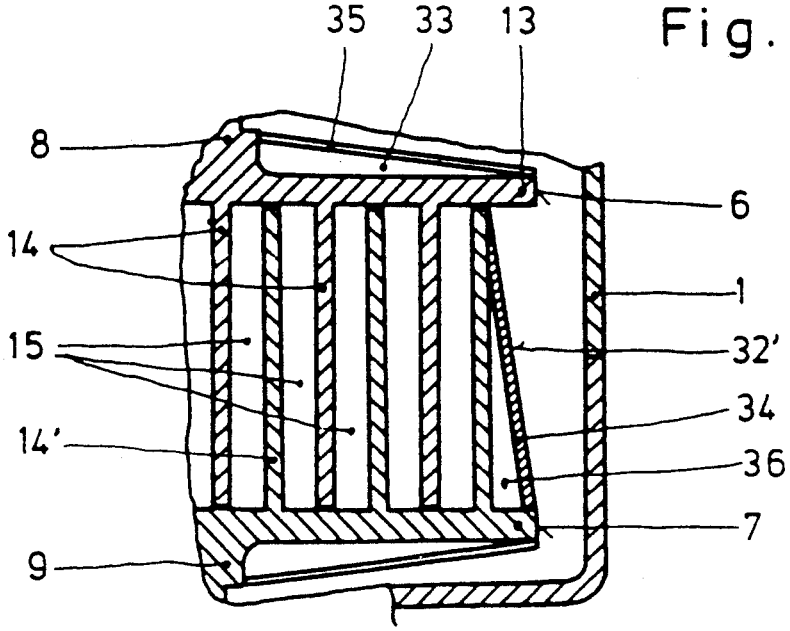
FIG. 3 is a partial longitudinal cross-sectional view of a second embodiment of a spiral charger in accordance with the present invention.

As another embodiment, FIGS. 3 and 4 shows a reinforcement 32' in a sandwich configuration. Such a configuration may be used, for example, when the rotating elements are produced by a casting or injection molding process. In this embodiment, a conical cover ring 34 extending from the outer edge of the displacer disk 6, 7 to the top end of the rib 14,14' may be connected by means of a plurality of webs 37 with the rib and, optionally, with the displacer disk. The cavity between the rib, the displacer disk and the cover ring is then filled preferably with an intermediate body 36 made, for example, from foam.

As an additional stabilizing measure of the rotating system, the displacer disks are also reinforced on their rear side facing the housing. In the case shown in FIG. 1, the reinforcements consist of webs 33 distributed uniformly over the circumference. Beginning at the hubs 8, 9, they extend to the outer edge of the corresponding displacer disk 6, 7. They are preferably conical and radial. The webs prevent the upward bending of the ribs 14,14' by centrifugal forces. To avoid ventilation losses, the webs 33 may be equipped according to FIG. 3 with a cover plate 35 on the side facing away from the displacer disk.

In operation, the displacer disks are rotated by a drive shaft 18 which is supported on ball bearings 19 in the housing 1 outside the displacer disks. Pulleys 20,20' are mounted on the drive shaft to drive by means of toothed belts 21,21' the pulleys 22' and 23'22' and 23' which, in turn, are fixedly connected to rotate the hubs 8 and 9, respectively, of the displacer disks.

During rotating motion, the spirals open against the inlet 17, from which fresh air is drawn. Due to the repeated alternating movement of the ribs 14,14' sickle shaped working spaces 15 are formed which are continuously displaced by the spirals from the inlet 17 in the direct of the outlet 16. The working medium conveyed in this manner is then discharged through the hollow axle stub 2 from the supercharger.

What is claimed is:

1. A rotating charger for compressible media having a housing in which two symmetrically constructed displacer disks are located and rotated about respective axes by respective first and second drive means and wherein the two displacer disks include helical ribs which radially oppose each other to form conveying spaces therebetween, an axial end of each rib engaging the opposing displacer disk to form a seal therewith, each conveying space including a radially outwardly located inlet and a radially inwardly located outlet, each rib including a radially outer end located at the inlet of a conveying space formed by that rib, a section of each rib disposed between its own radially outer end and the radially outer end of the next adjacent rib being reinforced by a reinforcement located on a radially outwardly facing rib wall and extending along substantially the entire dimension of the rib in the axial direction.

2. A spiral charger according to claim 1, wherein each displacer disk includes an outer peripheral edge, each reinforcement extending generally axially from a foot part of the rib which is joined to its respective displacer disk, a portion of the reinforcement being located at the foot part of the respective rib and lying flush with the outer peripheral edge of the respective displacer disk.

3. A spiral charger according to claim 1, wherein each rib includes a foot part which is joined to its respective displacer disk, each rib extending generally axially from its foot part and terminating at a top of the rib, each reinforcement being tapered when viewed in axial section such that a narrow end of the reinforcement is disposed adjacent the top of the respective rib, and a wide end of the reinforcement is disposed adjacent the foot part of the respective rib, each rib including a radially inwardly facing wall oriented parallel to the axial direction.

4. A spiral charger according to claim 1, wherein each reinforcement is of integral one-piece construction with its respective rib.

5. A spiral charger according to claim 4, wherein the displacer disks are formed of one of an aluminum alloy and magnesium, and wherein a radially outwardly facing surface of each reinforcement is surface hardened.

6. A spiral charger according to claim 1, wherein each reinforcement comprises a separate member attached to a radially outwardly facing surface of the respective rib.

7. A spiral charger according to claim 6, wherein the separate member forms a space with its respective rib, which space is filled with a foam.

8. A spiral charger according to claim 1, wherein each displacer disk includes a rear wall facing axially away from the ribs, the rear wall including a center hub, the rear wall including a plurality of radially extending webs, each web extending from an outer peripheral edge of the rear wall to the center hub.

9. A spiral charger according to claim 8, wherein each web is tapered when viewed in axial section such that a wide end of the web is located radially inwardly of its narrow end.

10. A spiral charger according to claim 8 including a cover plate extending across rear edges of the webs in contact with those rear edges to resist ventilation losses.

11. A spiral charger according to claim 1, wherein a non-reinforced portion of each rib spaced from the respective reinforcement is of rectangular cross-sectional shape.

* * * * *